US007520694B2

(12) United States Patent
Dvoracek

(10) Patent No.: US 7,520,694 B2
(45) Date of Patent: Apr. 21, 2009

(54) FLEXIBLE TRAFFIC REFLECTOR

(76) Inventor: Joe Dvoracek, 430 N. Varney St., Burbank, CA (US) 91502

( * ) Notice: Subject to any disclaimer, the term of this patent is extended or adjusted under 35 U.S.C. 154(b) by 0 days.

(21) Appl. No.: 11/702,242

(22) Filed: Feb. 3, 2007

(65) Prior Publication Data

US 2008/0187397 A1 Aug. 7, 2008

(51) Int. Cl.
*E01F 9/013* (2006.01)
*E01F 9/017* (2006.01)

(52) U.S. Cl. ..... 404/10; 404/9

(58) Field of Classification Search ..... 404/9, 404/10, 6; 116/63 R, 63 P
See application file for complete search history.

(56) References Cited

U.S. PATENT DOCUMENTS

| | | | | | |
|---|---|---|---|---|---|
| 1,668,486 | A | * | 5/1928 | Betts | 52/298 |
| 1,726,817 | A | * | 9/1929 | Franklin | 40/608 |
| 3,119,588 | A | * | 1/1964 | Keats | 248/158 |
| 3,279,133 | A | * | 10/1966 | De Korte | 52/103 |
| 3,380,428 | A | | 4/1968 | Abrams | |
| 3,912,405 | A | * | 10/1975 | Katt | 403/2 |
| 3,913,518 | A | * | 10/1975 | Kaplan | 116/63 C |
| 3,933,118 | A | | 1/1976 | Lyons | |
| 4,084,914 | A | * | 4/1978 | Humphrey et al. | 404/10 |
| 4,240,766 | A | * | 12/1980 | Smith et al. | 404/10 |
| 4,343,567 | A | * | 8/1982 | Sarver et al. | 404/10 |
| 4,486,117 | A | * | 12/1984 | Blau | 404/10 |
| 4,806,046 | A | * | 2/1989 | Clark | 404/10 |
| 4,833,566 | A | * | 5/1989 | Nickola | 361/664 |
| 4,925,334 | A | | 5/1990 | Beard | |
| 5,036,791 | A | | 8/1991 | Thurston | |
| 5,205,236 | A | * | 4/1993 | Hughes | 116/63 R |
| 5,207,175 | A | * | 5/1993 | Andonian | 116/209 |
| 5,215,033 | A | * | 6/1993 | Gipp et al. | 116/209 |
| 5,620,277 | A | * | 4/1997 | Cole et al. | 404/10 |
| 5,625,988 | A | * | 5/1997 | Killick | 52/298 |
| 5,749,673 | A | | 5/1998 | Kulp et al. | |
| D406,543 | S | | 3/1999 | Brown et al. | |
| 5,908,262 | A | | 6/1999 | Ahn | |
| D412,131 | S | | 7/1999 | Brent et al. | |
| 6,014,941 | A | | 1/2000 | Brent et al. | |
| D419,901 | S | | 2/2000 | Alt | |
| 6,113,307 | A | * | 9/2000 | Joyner et al. | 404/10 |
| 6,131,320 | A | | 10/2000 | Eberle et al. | |
| 6,769,380 | B1 | * | 8/2004 | Carvajalino et al. | 116/63 P |
| 6,769,509 | B2 | * | 8/2004 | Harwood | 181/199 |
| 7,186,054 | B2 | * | 3/2007 | Chambers | 404/9 |
| 2004/0076469 | A1 | * | 4/2004 | Audet | 404/10 |

* cited by examiner

*Primary Examiner*—Raymond W Addie
(74) *Attorney, Agent, or Firm*—Gene Scott; Patent Law & Venture Group

(57) ABSTRACT

A traffic control device is made up of a round lower tube of a rigid material, a round adapter tube of a flexible material, and a round upper tube of a rigid material. An upper portion of the upper tube provides a motorist recognizable indicia. A lower portion of the adapter tube is inserted axially within the lower tube and secured by mutually engaging portions of the tubes. An upper portion of the adapter tube is joined with the upper tube by mutually engaging fasteners. An upper end of the lower tube is spaced apart from a lower end of the upper tube by between one and five inches to allow for the adapter tube to bend by 90 angular degrees.

2 Claims, 1 Drawing Sheet

FLEXIBLE TRAFFIC REFLECTOR

CROSS-REFERENCE TO RELATED APPLICATIONS

Figure 1:
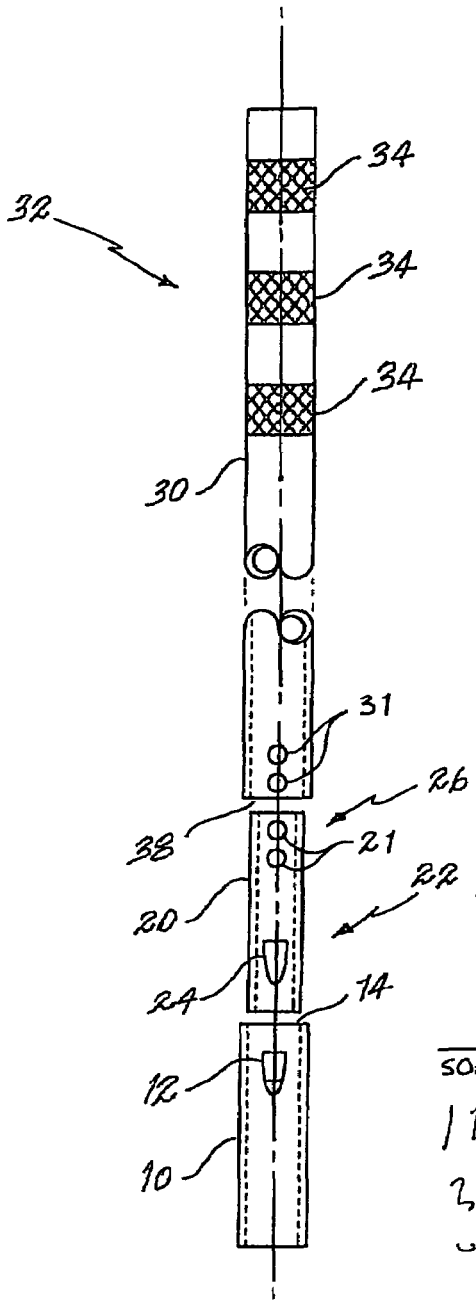

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to traffic control standup delineators or signs, and more particularly to a traffic control reflector having a flexible member capable of restoring the reflector to it vertical attitude after multiple impacts with automobiles.

2. Description of Related Art Including Information Disclosed Under 37 CFR 1.97 and 1.98

Brown et al., U.S. Pat. No. D406,543 describes a traffic channelizer design. Bent et al., U.S. Pat. No. D412,131 describes a traffic channelizing system design. Alt, U.S. Pat. No. D419,901 describes a safety marking pylon design. Abrams, U.S. Pat. No. 3,380,428 describes a traffic guide post means comprising a post member and a base member of mutually interfitting relationship. Lyons et al., U.S. Pat. No. 3,933,118 describes a signal device combining a fluorescent or phosphorescent light tube and a weighted base designed to be thrown or dropped from a vehicle as a warning marker. The light tube is preferably of the chemically actuated type and the base preferably has four resilient legs serving to ensure that the device will assume an upright position when dropped. Beard, U.S. Pat. No. 4,925,334 describes a traffic marker including an upright cone-shaped member and a base. Two orifices are provided on the upper end of the cone-shaped member and on opposite sides thereof. A bracket is provided having an interior portion and an exterior portion. The bracket is operable to be inserted through the orifice such that the distal end of the interior portion contacts the interior surface of the cone-shaped member at a point. An orifice is disposed in the interior member through which a flag can be inserted. The flag is inserted through the orifice on the opposite side of the cone-shaped member through the orifice to contact the opposite sides of the interior surface of the cone at a point. Thurston, U.S. Pat. No. 5,036,791 describes a stackable road delineator including an upright conical portion with a detachable weighted base. The top conical end has a handle graspable by the fingers of a human hand. Also, this end has a conical hollow interior so that when it is stacked on top of another similar delineator, the handle will freely fit within this hollow interior to thus provide stackable delineators. Kulp et al., U.S. Pat. No. 5,749,673 describes a safety delineator which includes a conical body portion to which is attached one or more vertical panels. A new and improved handle feature permits easy and comfortable full hand gripping of the delineator and also prevents sticking and jamming together of a plurality of the delineators when they are stacked. The delineators may be stacked without removing the vertical panels, since each vertical panel is particularly designed to wrap around the conical body portion to which it is attached as another vertical delineator slides over it. Ahn, U.S. Pat. No. 5,908,262 describes a basally adhered, self-recovering traffic lane delineator having a cylindrical post made of flexible material, having the air outlet and inlet on the center of its upper surface, and a supplementary support panel placed and adhered underneath the post. The support panel supports a lower part of the post and is adhered on the ground. Owing to its small package volume, the delineator is easy to move and safeguard. Bent et al., U.S. Pat. No. 6,014,941 describes a traffic delineator including a cylinder and a base. The base has a hole therethrough to permit the cylinder to be inserted into the base and the base then holds the cylinder down. A grip is formed in the center section of the cylinder to increase ease of carrying the delineator. The cylinder may also include a handle and means for affixing traffic warning lights and flags. The base may include means for holding removable ballast. The cylinder is formed by blow molding. Eberle et al., U.S. Pat. No. 6,131,320 describes a free standing display panel with a foldable floor sign including an integrally formed handle portion and male and female hinge projections. The male and female hinge projections snap together into interlocking engagement with each other in response to simultaneous axial compression. The male coupling member includes a resilient finger portion and a latching head, and the female coupling member includes a cylindrical collar having a latch pocket and a radially stepped, inwardly projecting retainer. The resilient finger portion is radially deflectable in response to sliding engagement of the latching head against the retainer to permit the latching head to clear the retainer and enter the latch pocket. The display panels are stabilized in a spread-apart service position by a locking arm that is pivotally coupled to the display panels for folding movement within longitudinal slots formed along side edges of the display panels. Two or more floor signs are linked together by chains to provide a wide area barrier to entry.

The related art described above discloses several traffic control devices. However, the prior art fails to disclose a standup reflector with a flexible section enabling the device to sustain many impacts with passing automobiles while retaining its ability to resume its vertical position. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A traffic control device is made up of a round lower tube of a rigid material, a round adapter tube of a flexible material, and a round upper tube of a rigid material. An upper portion of the upper tube provides a motorist recognizable indicia. A lower portion of the adapter tube is inserted axially within the lower tube and secured by mutually engaging portions of the tubes. An upper portion of the adapter tube is joined with the upper tube by mutually engaging fasteners. An upper end of the lower tube is spaced apart from a lower end of the upper tube by between one and five inches to allow for the adapter tube to bend by 90 angular degrees.

A primary objective inherent in the above described apparatus and method of use is to provide advantages not taught by the prior art.

Another objective is to provide a traffic reflector that is able to be bent-over by high speed impacts many times while maintaining its ability to right itself.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Figure 2:
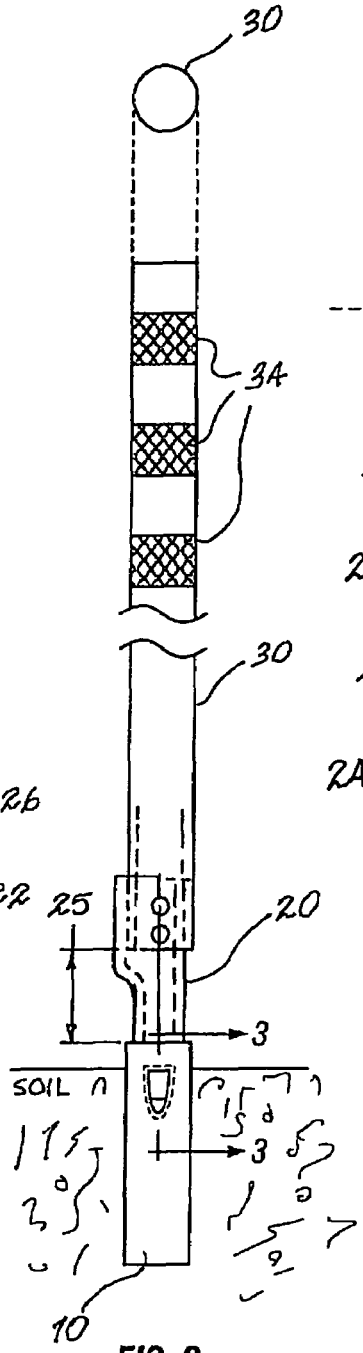
Figure 3:
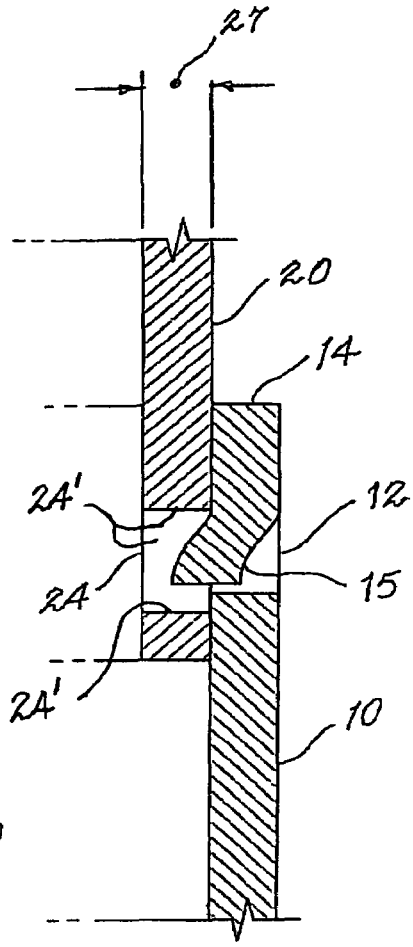

Illustrated in the accompanying drawing(s) is at least one of the best mode embodiments of the present invention In such drawing(s):

FIG. 1 is a elevational view of the presently described apparatus shown with its several parts separated along its central axis;

FIG. 2 is a further elevational view thereof shown as assembled with an adapter tube shown on the left side as extending outside an upper tube, and shown on the right side as fitting within the upper tube, and showing a plan view projected at the upper portions of the figure to show the circular cross sectional nature of the apparatus; and FIG. 3 is a cross-sectional view thereof taken along line 3-3 in FIG. 2 showing the manner in which the adapter tube engages a lower tube of the apparatus.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail is a traffic control device, as shown in the above described figures, having a round lower tube 10 of a rigid material, preferably a metal, a round adapter tube 20 of a flexible material, preferably a polyurethane plastic, and a round upper tube 30 of a rigid material, preferably polypropylene. An upper portion 32 of the upper tube 30 provides a motorist recognizable indicia 34 such as reflective surfaces, traffic control symbols, traffic control printed information, or traffic control lights, all of which are well known in the art. A lower portion 22 of the adapter tube 20 is inserted axially within the lower tube 10 and secured therewith by mutually engagable and releasable portions 24 and 12 respectively, as best shown in FIG. 3. Portion 12 provides for a rigid finger 15 which engages opening 24. This allows portion 24 to receive portion 12 in such manner that portion 24 cannot disengage from portion 12 by simple linear axial movement. However, if adapter tube 20 is first pushed downwardly to disengage portions 12 and 24, and then rotated within lower tube 10, adapter tube 20 can be removed from lower tube 10 by axial upward relative movement with stationary lower tube 10. This is critical to the objectives of the invention since the upper tube 30 may need to be quickly replaced from time to time when alternate indicia 34 is required or if the upper tube 30 is damaged by a collision. An upper portion 26 of the adapter tube 20 is joined with a lower end 36 the upper tube 30 and engaged therewith by mutually engaging fasteners such as bolts, or rivets secured in holes 31 and 21 (FIG. 1).

Preferably, an upper edge 14 of the lower tube 10 is spaced apart from a lower edge 38 of the upper tube 30, as shown in FIG. 2, by between one and five inches (exposed length 25 of adapter tube 20), and the adapter tube 20 has a wall thickness 27 of between 0.065 and 0.375 inches (FIG. 3).

The adapter tube 20 is made of a polyester-based thermoplastic polyurethane elastomer, preferably either Elastollan® S85A55N or Elastollan® S98A53N, having a durometer hardness of between 85 and 98 on the "A" scale and approximately 54 on the "D" scale.

The above described formula of the adapter tube 20, i.e.; exposed length, wall thickness, material, and hardness, enables the apparatus to sustain a vehicular impact driving the upper tube from its vertical attitude, at rest, to an essentially horizontal attitude with a repetition of at least several thousands of such occurrences (cycles) without loss of it ability to right itself to its at-rest vertical attitude. Additionally, the direction of impact is inconsequential since the apparatus is symmetrical about its own vertical axis. It has been found that any change in the above described formula outside the above described parameters results in severely reduced or unacceptable performance. Such degraded performance includes the following:

a) failure in shear at the adapter tube 20.

b) failure in pull-out of the adapter tube 20 from the lower tube 10.

c) failure through loss of auto-restoration (self-righting).

d) failure to sustain repeated cycles without severe degradation.

The present traffic control device is described in further detail as the round adapter tube 20 co-axially joined within the lower tube 10 with the adapter tube 20 further joined co-axially with the upper tube 30. The rigid finger 15 of the lower tube 10 is positioned within the opening 24 in the adapter tube 20, the rigid finger configured and positioned to abut an edge 24' of the opening 24 during upward axial motion, and during rotational motion, of the adapter tube 20 which thereby prevents disengagement of the adapter tube 20 from the lower tube 10 as is clearly shown in FIG. 3. The rigid finger 15 is also configured and positioned so that the edge 24' of the opening 24 is flexibly movable over the rigid finger 15 during downward axial motion of the adapter tube 20 since it made of a flexible material as previously described and thereby enabling disengagement of the opening of the adapter tube 20 from the rigid finger 15.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A traffic control device comprising: a round adapter tube of a flexible material joined co-axially within a round, vertically oriented lower tube of a rigid material, the lower tube fixedly supported in a ground surface, the adapter tube further joined co-axially with a rigid upper tube having a motorist recognizable indicia; an upper edge of the lower tube spaced apart from a lower edge of the upper tube by between one and five inches of exposed length of the adapter tube; a rigid finger of the lower tube positioned within an opening in the adapter tube, the rigid finger configured and positioned to abut an edge of the opening during upward axial motion, and during rotational motion, of the adapter tube thereby preventing disengagement of the adapter tube from the lower tube; the rigid finger further configured and positioned so that the edge of the opening is flexibly movable over the rigid finger during downward axial motion of the adapter tube thereby enabling disengagement of the opening of the adapter tube from the rigid finger; whereby upon an impact with the upper tube, the adapter tube bends to enable the upper tube to move from a starting vertical position to a horizontal position and thereafter back to the vertical position as the flexible adapter tube rebounds.

2. A method of using a traffic control device comprising the steps of:

a) forming a round adapter tube of a flexible material, the adapter tube having an opening therein;

b) coaxially joining the adapter tube with a fixed, rigid, vertically oriented, round, lower tube;

c) coaxially joining the adapter tube with a rigid upper tube having a motorist recognizable indicia, wherein a lower edge of the upper tube is spaced apart by between one and five inches from an upper edge of the lower tube;

d) forming a rigid finger in the lower tube so as to protrude within the opening in the adapter tube;

e) forming the rigid finger and the opening so that during upward axial motion, the rigid finger abuts an edge of the opening, and during rotational motion, of the adapter tube thereby preventing disengagement of the adapter tube from the lower tube;

f) forming the rigid finger further so that the edge of the opening is flexibly movable over the rigid finger during downward axial motion of the adapter tube thereby enabling disengagement of the opening of the adapter tube from the rigid finger whereby upon an impact with the upper tube, the adapter tube bends to enable the upper tube to move from a starting vertical position to a horizontal position and thereafter back to the vertical position as the flexible adapter tube rebounds.

* * * * *